US005127656A

United States Patent [19]

Simpson

[11] Patent Number: 5,127,656

[45] Date of Patent: Jul. 7, 1992

[54] BINGO GAME APPARATUS

[76] Inventor: Samuel R. Simpson, Rte. 1, Box 171, Waverly, Tenn. 37185

[21] Appl. No.: 729,175

[22] Filed: Jul. 12, 1991

[51] Int. Cl.[5] ..... A63F 3/06

[52] U.S. Cl. ..... 273/269; 273/271

[58] Field of Search ..... 273/269, 271

[56] References Cited

U.S. PATENT DOCUMENTS

| | | | |
|---|---|---|---|
| 1,564,746 | 12/1925 | Barnard | 273/271 |
| 1,871,247 | 8/1932 | Trost | 273/271 |
| 3,441,280 | 4/1969 | Eggermont | 273/271 |
| 4,019,744 | 4/1977 | Pizur, Sr. | 273/269 |
| 4,489,948 | 12/1984 | Keyser | 273/269 X |
| 5,029,871 | 7/1991 | Wilson, Jr. et al. | 273/271 |

*Primary Examiner*—William H. Grieb
*Attorney, Agent, or Firm*—Leon Gilden

[57] ABSTRACT

A bingo game is operative in association with playing cards, wherein the playing cards are provided to associate by coloration and enumeration various digits with associated digits upon a game board. The object is to direct individuals or teams to effect completion of a plurality of five in a row or one ten in a row along the game board.

3 Claims, 4 Drawing Sheets

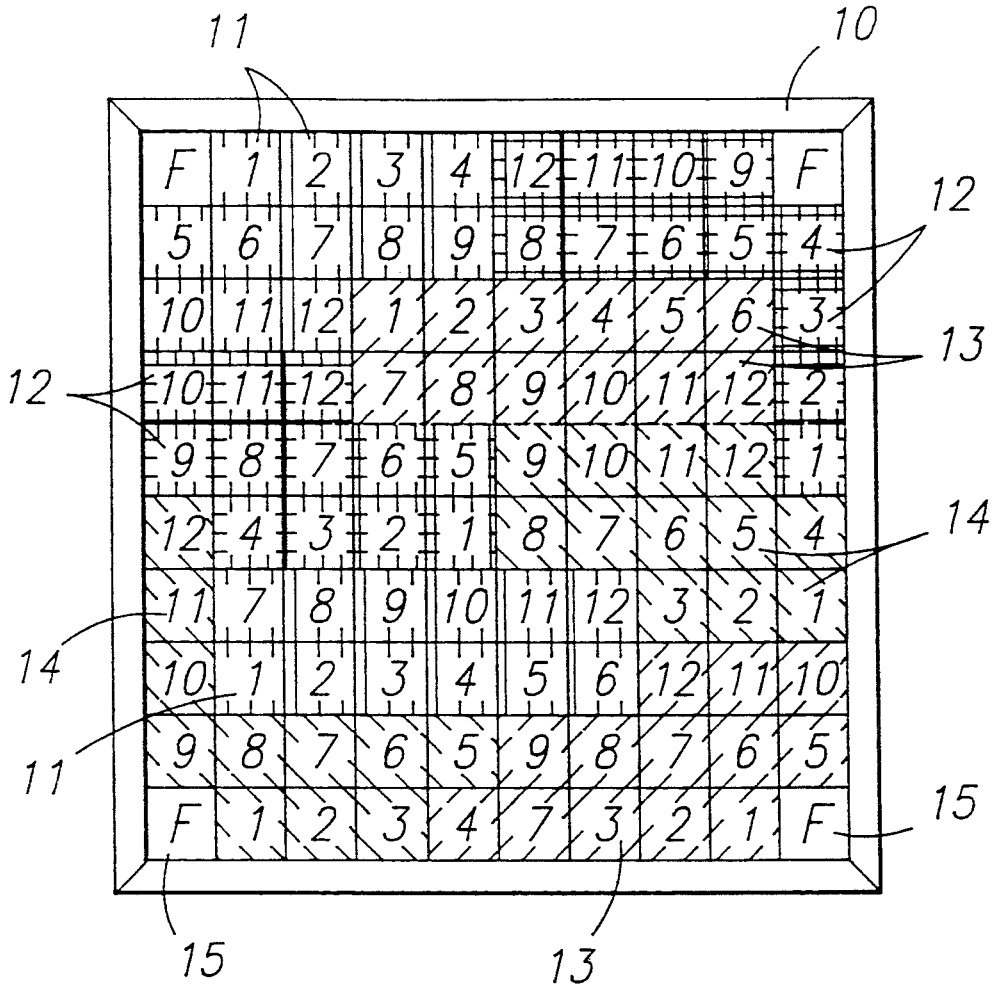
Fig 1
Fig 2
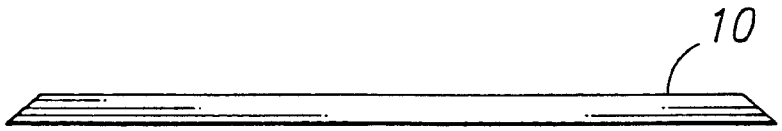

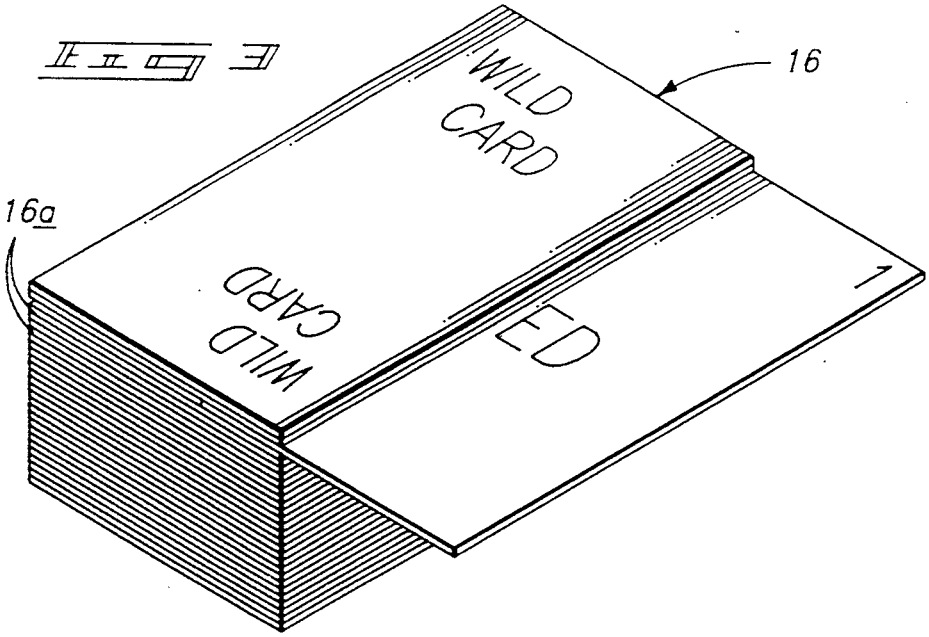
Fig 3
19
| MARKING | RED | YEL | BLUE | GRN | BLCK | TOTAL |
|---|---|---|---|---|---|---|
| 1 | 2 | 2 | 2 | 2 | | |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |
| 11 | | | | | | |
| 12 | 2 | 2 | 2 | 2 | | 4 |
| WILD | | | | | 4 | 4 |
| TOTAL | | | | | | 100 |
Fig 4
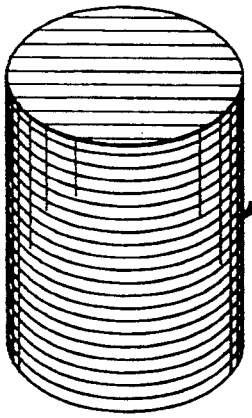
Fig 5
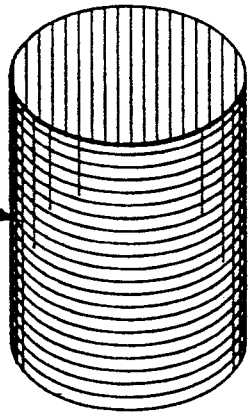
Fig 6

Fig 9
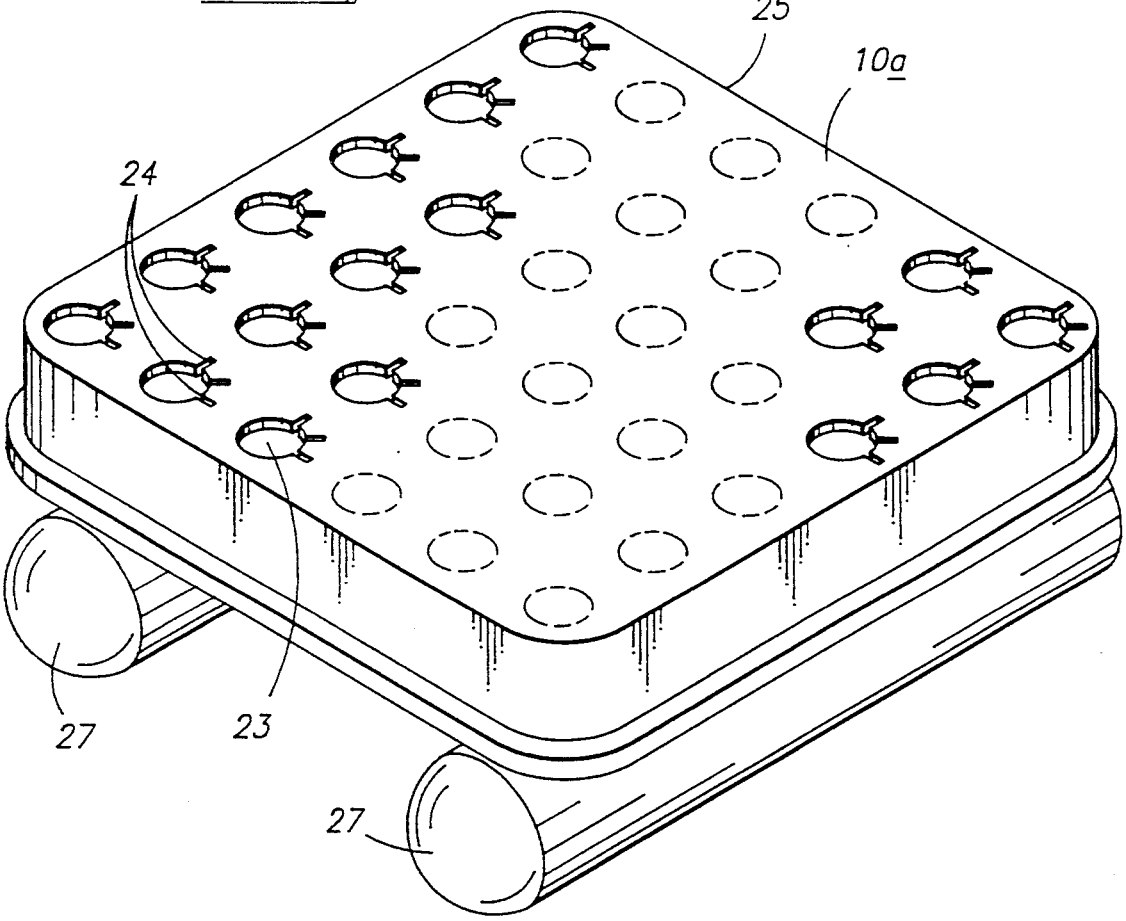
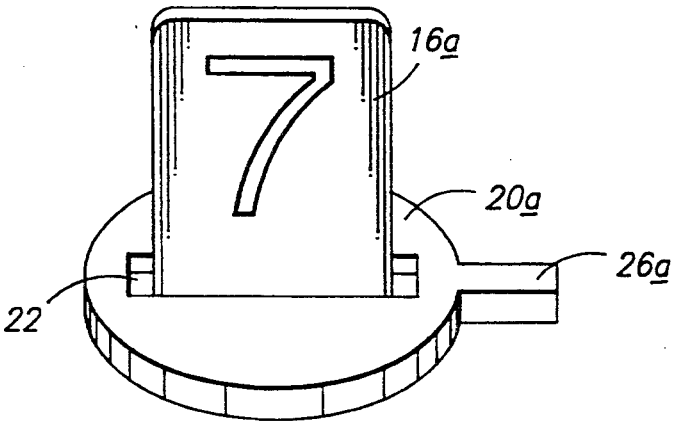
Fig 10

BINGO GAME APPARATUS

BACKGROUND OF THE INVENTION

1. Field of the Invention

The field of invention relates to bingo games, and more particularly pertains to a new and improved bingo game apparatus wherein the same is directed to provide amusement and entertainment in the effecting of five or ten in a row along straight or diagonal rows.

2. Description of the Prior Art

Various bingo game apparatus is utilized in the prior art and may even utilize associated colorations, such as set forth in U.S. Pat. No. 4,019,744 to Pizur, Sr. wherein color coding of quadrants of the card, as well as number in the center, is utilized associated with corresponding colored chips.

U.S. Pat. No. 4,489,948 to Keyser sets forth a color card pack utilizing the cards in various noted popular games, such as "Quest".

The instant invention presents a combination to accommodate various colorations and enumerations and utilize the thusly drawn cards in an operative association relative to one another in enhanced amusement and enjoyment of the game. As such, there appears to be a need for a new and improved bingo game apparatus as set forth by the instant invention which addresses this consideration and in this respect, the present invention sunstantially fulfills this need.

SUMMARY OF THE INVENTION

In view of the foregoing disadvantages inherent in the known types of bingo game apparatus now present in the prior art, the present invention provides a bingo game apparatus wherein the same is arranged to coordinate various colorations of a card deck and disks to opposing teams to effect association of a row of bingo chips to provide a winning of the game. As such, the general purpose of the present invention, which will be described subsequently in greater detail, is to provide a new and improved bingo game apparatus which has all the advantages of the prior art bingo game apparatus and none of the disadvantages.

To attain this, the present invention provides a bingo game operative in association with playing cards, wherein the playing cards are provided to associate by coloration and enumeration various digits with associated digits upon a game board. The object is to direct individuals or teams to effect completion of a plurality of five in a row or one ten in a row along the game board.

My invention resides not in any one of these features per se, but rather in the particular combination of all of then herein disclosed and claimed and it is distinguished from the prior art in this particular combination of all its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bingo game apparatus which has all the advantages of the prior art bingo game apparatus and none of the disadvantages.

It is another object of the present invention to provide a new and improved bingo apparatus which may be easily and efficiently manufactured and marketed.

It is a further object of the present invention to provide a new and improved bingo game apparatus which is of a durable and reliable construction.

An even further object of the present invention is to provide a new and improved bingo game apparatus which is susceptible of a low cost of manufacture with regard to both materials and labor, and which accordingly is then susceptible of low prices of sale to the consuming public, thereby making such bingo game apparatus economically available to the buying public.

Still yet another object of the present invention is to provide a new and improved bingo game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of the board of the instant invention.

FIG. 2 is an orthographic side view of the board of the invention.

FIG. 3 is an isometric illustration of a deck of cards utilized in association with a game of the invention.

FIG. 4 is an orthographic view of a typical score card utilized by the invention.

FIGS. 5 and 6 are isometric illustrations of the contrastingly colored bingo chips for use in the game.

FIG. 9 is an isometric illustration of a further modified game board of the invention.

FIG. 10 is an isometric illustration of a further modified bingo chip in association with the game board, as illustrated in FIG. 9.

DESCRIPTION OF THE PREFERRED EMBODIMENT

Figure 7:
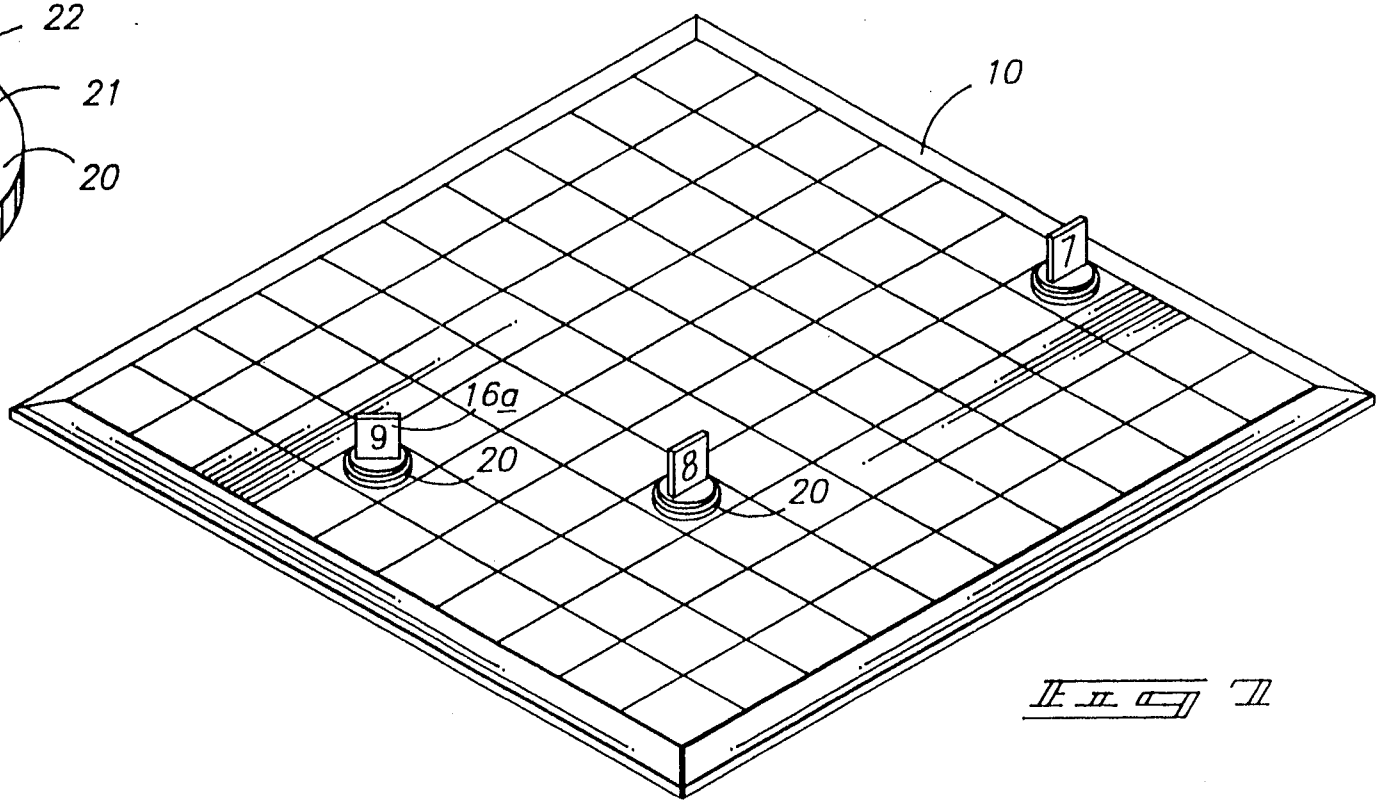
FIG. 7 is an isometric illustration of a modification of the bingo chips in utilization with a board of the instant invention.

With reference now to the drawings, and in particular to FIGS. 1 to 10 thereof, a new and improved bingo game apparatus embodying the principles and concepts of the present invention and generally designated by the reference numbers 10–27 will be described.

More specifically, the bingo game apparatus of the invention essentially comprises a rigid game board 10, including plural rows and columns defining a matrix of squares, wherein the squares are divided into five groups including a first group defined by red squares 11, a second group of yellow squares 12, a third group of blue squares 13, a fourth group of green squares 14, and a fifth group of free squares 15. The free squares are positioned at each corner intersection about the perimeter of the game board of the rows and columns of squares, wherein the first through fourth groups 11–14 are defined by a plurality of such groups, each enumerated from 1-12 throughout the game board. A card deck 16 is provided defined by one hundred four cards, with twenty-four cards afforded each group and in each group of twenty-four cards and associated coloration, the cards are enumerated from 1-12 and duplicated to provide the twenty-four cards. Four additional first wild cards are provided permitting a player to remove an opposing player's disk from the game board, wherein four second wild cards are provided permitting a player to position that player's disk as desired throughout the game board. A plurality of respective blue and red marker disks 17 and 18 are provided to provide marking upon the game board, wherein the blue and red marker disks are associated with a respective associated first and second group of opposing player or players. A score card 19 is provided as optional equipment permitting each player or team to maintain scoring during play of the game.

In play of the game, the respective blue and red disks 17 and 18 are afforded to each player or team, then the card deck 16 is shuffled and each player given five cards. The remaining cards are split into a plurality of stacks and positioned conveniently in opposing corners of the board so opposing players may have access to the cards. Taking turns, each player positions a card down in front of that player and then takes a chip and places it on one of the plurality of places that card has designated that positioning of the chip may be positioned. A player that matches the card draws a card from the stack so that player may always be afforded five cards. If that player forgets to draw before the next player plays, that player must wait until a subsequent turn. The team that obtains five in a row, either vertically, horizontally, or diagonally in a plurality of rows, is a winner or a player or team that positions ten disks in a row wins an associated game. Once a team or player positions at least five disks in a row, an opposing player or team may not remove any of the disks utilizing the first wild cards, as discussed above.

Figure 8:
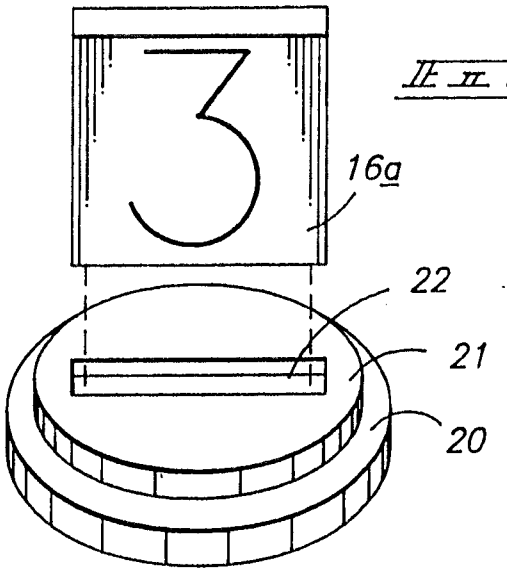
FIG. 8 is an enlarged isometric illustration of the modified bingo chip construction of the instant invention.

FIG. 8 illustrates a modified disk structure 20 to be provided for each of the plurality of blue or red disks 17 and 18, wherein the disk 20 includes a planar top surface with a groove 21 positioned within the top surface, wherein a playing **16*a* of the plurality of playing cards once drawn is in position in the associated groove 22. In this manner, the modified disks 20 are positioned such that the cards are aligned to indicate in which orientation the row is to take place, either horizontally, vertically, or at a forty-five degree angle relative to an associated space of the matrix of spaces or squares 11–15. FIG. 10 illustrates a further modified disk structure 20*a*, wherein the groove 22 receives the cards 16*a* as noted before, but is also formed with a radially projecting leg 26. The radially projecting leg 26 is aligned within an associated cylindrical recess defined by a predetermined cylindrical diameter 23 within the modified game board 10*a*, and wherein the projecting leg 26 is received within an associated radial slot 24 of a trio of radial slots defined at ninety degrees, forty-five degrees, and zero degrees relative to a top edge 25 of the game board 10*a*. In this manner, the cylindrical disk defined by the predetermined diameter is fixedly maintained in either a vertical, horizontal, or diagonal orientation to indicate proper orientation of a predetermined row to be attained by that player or team. Further, if desired, this structure may include pneumatic cylinders 27 mounted to opposed sides of the modified game board 10*a*** to permit utilization of the game board and associated pieces within a swimming pool and the like to accommodate play in an aquatic environment to further enhance enjoyment and versatility of the game in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bingo game apparatus, comprising, a game board, the game board including a matrix of squares formed thereabout defined by respective columns and rows of squares, and the squares include a first, second, third, fourth, and fifth group of squares, and a card deck, the card deck including a plurality of cards, the plurality of cards include indicia associated with each of the five groups of squares to direct a player to a square of the groups of squares, and a plurality of groups of disks, the plurality of groups of disk are provided for positioning upon a square of the groups of squares for visual indication of association of one of said squares of the groups of squares in association with one of said cards of said card deck, and each disk is defined by a predetermined cylindrical diameter, and includes a planar top surface, the planar top surface including an enclosed groove positioned within the top surface, and the groove defined by a predetermined length, and each card of the card deck defined by a predetermined width, wherein the predetermined width is less than the predetermined length of the grooved repositioning of the card within the groove to associate the card with the square of the said groups of squares.

2. An apparatus as set forth in claim 1, wherein the game board includes a top edge, and each square of the groups of squares includes a cylindrical recess defined by a diameter equal to the predetermined diameter, and each cylindrical recess includes a respective first, second, and third radial slot oriented at ninety degrees, forty-five degrees, and zero degrees relative to the top edge of the game board, and each disk includes a radially projecting leg, and each radially projecting leg defined by a predetermined length, and each radial slot defined by the predetermined length to complementarily position defined by the predetermined length to complementarily position each disk in associated radial leg within the cylindrical recess and one of said radial slots.

3. An apparatus as set forth in claim 2, wherein the game board includes a plurality of pneumatic cylinders fixedly mounted to a bottom surface of the game board at opposed side edges thereof to provide buoyancy to the game board for use in an aquatic environment.

* * * * *